US011515631B2

(12) United States Patent
Friman

(10) Patent No.: US 11,515,631 B2
(45) Date of Patent: Nov. 29, 2022

(54) WIDEBAND ANTENNA

(71) Applicant: SHORTLINK RESOURCES AB, Karlstad (SE)

(72) Inventor: Alf Friman, Karlstad (SE)

(73) Assignee: SHORTLINK RESOURCES AB, Karlstad (SE)

( * ) Notice: Subject to any disclaimer, the term of this patent is extended or adjusted under 35 U.S.C. 154(b) by 59 days.

(21) Appl. No.: 16/651,601

(22) PCT Filed: Sep. 28, 2018

(86) PCT No.: PCT/SE2018/050997
§ 371 (c)(1),
(2) Date: Mar. 27, 2020

(87) PCT Pub. No.: WO2019/066713
PCT Pub. Date: Apr. 4, 2019

(65) Prior Publication Data

US 2020/0303818 A1 Sep. 24, 2020

(30) Foreign Application Priority Data

Sep. 28, 2017 (SE) ..... 1751201-3

(51) Int. Cl.
*H01Q 5/25* (2015.01)
*H01Q 5/364* (2015.01)
*H01Q 1/48* (2006.01)

(52) U.S. Cl.
CPC ..... *H01Q 5/25* (2015.01); *H01Q 1/48* (2013.01); *H01Q 5/364* (2015.01)

(58) Field of Classification Search
CPC ..... H01Q 9/28; H01Q 9/16; H01Q 9/0407; H01Q 9/0414; H01Q 9/285; H01Q 5/25;
(Continued)

(56) References Cited

U.S. PATENT DOCUMENTS 8,614,649 B2 * 12/2013 Sakuma ..... H01Q 1/521 343/795
2004/0164903 A1 8/2004 Tran
(Continued)

FOREIGN PATENT DOCUMENTS

EP 1717902 A1 * 11/2006 ..... H01Q 1/48
EP 1993169 A1 11/2008
EP 1993169 A4 9/2009

OTHER PUBLICATIONS

International Search Report and Written Opinion for International Application No. PCT/SE2018/050997, dated Nov. 29, 2018 (12 pages).
(Continued)

*Primary Examiner* — Ricardo I Magallanes
(74) *Attorney, Agent, or Firm* — Kagan Binder, PLLC

(57) ABSTRACT

A wideband/broadband antenna is described, comprising a dielectric substrate with a first surface with an antenna feed with two conductors, comprising a first feed connection and a second feed connection, wherein the second feed connection is or acts as the ground. A first conductive layer extends from the antenna feed in a first direction and is electrically connected to the first feed connection, wherein the first conductive layer extends in a direction away from the antenna feed, and to a first end edge. A second conductive layer extends in a second direction, away from the first conductive layer, and is electrically connected to the second feed connection. A non-conductive zone separates the first and second conductive layers. On a second surface of the substrate there is a third conductive layer which extends from a second end edge in the direction towards the antenna feed, the extent of which at least in part coincides with that of the first conducting layer at the first surface. The first end edge of the first conducting layer and the second end edge of the third conducting layer substantially coincides, and the
(Continued)

first and third electrical layers are electrically connected with each other at or near said end edges. Apart from said electrical interconnection at the edges, the layers are electrically separated from each other.

19 Claims, 5 Drawing Sheets

(58) Field of Classification Search
CPC .. H01Q 9/26; H01Q 9/30; H01Q 9/40; H01Q 9/42
See application file for complete search history.

(56) References Cited

U.S. PATENT DOCUMENTS

2006/0082504 A1* 4/2006 Chen ..... H01Q 1/243 343/700 MS
2007/0120741 A1 5/2007 Tseng
2009/0135084 A1* 5/2009 Huang ..... H01Q 5/371 343/893
2010/0231477 A1* 9/2010 Kuramoto ..... H01Q 9/26 343/795
2012/0306702 A1 12/2012 Kaneko et al.
2013/0050028 A1 2/2013 Nogami
2014/0132466 A1 5/2014 Inoue et al.
2014/0327593 A1 11/2014 Wong et al.
2015/0054706 A1 2/2015 Shimura et al.

OTHER PUBLICATIONS

Chinese Office Action for Chinese Application No. 201880067008.6, dated Oct. 11, 2021 (7 pages).
E-Space net English Abstract for EP1993169A4.
Extended European Extended Search Report for European Application No. 18862642.8, dated Jun. 4, 2021 (11 pages).

* cited by examiner

WIDEBAND ANTENNA

CROSS-REFERENCE TO RELATED APPLICATIONS

This application claims priority to International Application No. PCT/SE2018/050997, filed Sep. 28, 2018 and titled "WIDEBAND ANTENNA," which in turn claims priority from a Swedish Patent Application having serial number 1751201-3, filed Sep. 28, 2017, titled "WIDEBAND ANTENNA," both of which are incorporated herein by reference in their entireties.

TECHNOLOGY AREA

The present invention relates to a broadband/wideband, Omnidirectional antenna.

BACKGROUND

There is a large and growing need of omnidirectional, broadband/wideband antennas. An increasing number of appliances and devices are now connected to the wireless network, and with the trend towards the "Internet of Things (IoT) everyday items such as household appliances, clothes, accessories, machines, vehicles and buildings are now more frequently equipped with wireless connections. This enables the devices to receive commands from users and other entities, in order to be able to be controlled remotely, to forward information from sensors and the like, etc. To provide good antennas for this type of use is still a major problem. When applied to devices, such as household appliances, antennas are often placed in bad positions, seen from the point of view of radiation and communication. Where the antennas with which the device will communicate are positioned is usually not foreseeable by the manufacturer. Moreover, there is a need to use the same or similar products on many different markets, which poses problems when communicating because different frequency bands are used in different parts of the world, etc.

There is therefore a need for a robust and efficient antenna which is omnidirectional and wideband/broadband, and thus can be used in many different environments and situations, and in a number of different frequency bands.

Characteristics that generally can be said to characterize a well-performing omnidirectional antenna is:

- Low-losses: The EM power being fed into/from the antenna will be delivered/received without significant losses. Losses are primarily due to impedance mismatching and resistive losses. Physically large enough space is a precondition for low losses for a given wavelength for resonant aerials. The minimum length for resonance is half a wavelength. Losses are usually defined as a percentage efficiency, where 100% efficiency is a hypothetical ideal antenna without any material losses.
- Physically small size: This is often high on the wish list of today's compact wireless electronics. Unfortunately, however, it becomes an opposed condition to the condition for resonance, which requires a certain minimum physical size.
- Bandwidth: Depending on the intended use of the antenna, the need for frequencies which the antenna is designed for varies. Some radio applications cope with very narrow frequency bands, such as GPS. Broadband antennas, however, must handle a broad continuous frequency range. Broadband antennas should be capable of being resonant for multiple frequency bands. This is difficult to achieve design wise without decreased cost efficiency. It has become particularly difficult since mobile telephony and data covers many and broad frequency ranges, ranges which also vary between different parts of the world, so that the total demand of coverage becomes very large. LTE (4G) is commonly found in the frequency ranges 700-1000, 1600-2400, 2500-2700 MHz. Within these bands we will also find 2G and 3G.

The choice of antenna type is depending on which properties to be prioritized. In a mobile phone priority is primarily given to small size properties, instead of other properties. One can accept aerial losses of 70-80% if it admits small dimensions. Since the antenna is built-in, and thus has a short height above the ground plane, it often requires an antenna type that can work, if not good, then at least decent in respect of the low altitude. For selection of an antenna at a house and car-mounted, monopole-type antennas often work well. In such an antenna, there are ribs/arms whose length only needs to be one quarter of a wavelength long, since a second quarter-wavelength is available as a reflection in the ideal ground plane on which the antenna is placed.

Often, such as the connection in the Internet of Things, there is, however, a need for antennas that are smaller than a car antenna, and that can work even without an ideal ground plane. Preferably, the bandwidth should cover the frequencies for all wireless telephony and data, regardless of continent. To have an antenna that covers all existing markets is important. It makes the logistics easy for the manufacturer of such equipment, because you only need to have an antenna type, regardless of sales market.

In the context of the nowadays extreme bandwidth demands, due to the development of the telephony, an antenna that is optimal at a single frequency cannot be provided, but a compromise has to be found, accepting a slightly lower efficiency but gaining a somewhat greater bandwidth, which in this case is valued higher. It is also often a requirement that the antenna should function well without access to an external ground plane.

Antennas designed for this purpose are therefore compromise solutions, dimensioned and composed out of different partial solutions that provide the antenna's total properties. If the antenna is to perform well, regardless of the external ground plane, however, one becomes bound by physical laws, related to how good an antenna it is possible to achieve at a minimum physical extent. Antenna types that are common for such applications are dipole-antennas, which have two equal arms with an arm length equal to half a wavelength, loop antennas, where the perimeter corresponds to a wavelength, and monopole-antennas with internal ground plane. In respect of monopole-antennas, one way to increase the usable frequency range of the antenna is e.g. to have multiple sub-arms with different length. It is also known to create a continuous surface that admits many different length extensions to be provided in the conducting layer, to allow resonance lengths for multiple frequencies. Such antennas often include a conducting aerial layer printed on a printed circuit board (PCB), and a second layer that forms the ground plane. The basic rule for these antennas is that ground plane must have the same physical extension as the antenna element. Otherwise, it would not fit a full mirror image. The ground plane may have a horizontal extension, but could also have a vertical extension. The ground plane and the antenna provided on the PCB can be arranged on the same side of the substrate, but can alternatively be located on separate side.

These known omnidirectional, broadband antennas, however, still suffer from many problems, such as lack of performance in certain frequency ranges, too low broadband performance, too large dimensions, etc.

There is therefore a need for a new omnidirectional, wideband/broadband antenna that fulfills at least one, and preferably all, of the following objects: good performance and efficiency in all the relevant frequency ranges, relatively compact, with small dimensions, cost-effective to manufacture, and adequate performance independent of environment and surroundings.

SUMMARY OF THE INVENTION

It is thus an object of the present invention to provide a wideband/broadband antenna that at least partially eliminate the above discussed problems of the known technology. This purpose is achieved with an antenna in accordance with the appended claims.

In accordance with the first aspect of the invention there is provided a wideband/broadband antenna comprising:

a dielectric substrate with a first and second surface, wherein the first surface comprises:

an antenna feed with two conductors, comprising a first feed connection and a second feed connection, wherein the second feed connection is or acts as the ground;

a first conductive layer which extends from the antenna feed in a first direction and which is electrically connected to the first feed connection, wherein the first conductive layer extends in a direction away from the antenna feed, and to a first end edge;

a second conductive layer that primarily extends in a second direction, away from the first conductive layer, and which is electrically connected to the second feed connection; and a non-conductive zone separating the first and second conductive layers;

and wherein the second surface comprises:

a third conductive layer which extends from a second end edge in the direction towards the antenna feed, the extent of which at least in part coincides with that of the first conducting layer at the first surface, the first end edge of the first conducting layer and the second end edge of the third conducting layer substantially coinciding, and wherein the first and third electrical layers are electrically connected with each other at or near said end edges, and wherein the first and third layer, apart from said electrical interconnection at the edges, are electrically separated from each other.

The antenna feed and the first and second feed connections should be understood as electrical wiring or lines and connection points to such wiring or lines. The wiring may comprise wires in a cable, such as a coaxial cable, and connectors can be directly attached to these wires. The wiring may, however, also comprise circuit/wiring pattern(s) on the dielectric substrate, or a combination of cable(s) and circuit/wiring pattern(s).

The first and third electrical layers being electrically connected with each other at or near the end edges should, in this context, be understood in such a way that the electrical connection is at the end edges, or within a certain distance from there, this distance, however, being much smaller than the distance to the feed connection. The interconnection may, e.g. be arranged at one or several places along the end edges, and/or at the long sides of the layers, in the vicinity of the end edges. The interconnection can also be arranged at one or several positions within the layers, at a certain distance from the end edges.

The new antenna has surprising been shown to have excellent antenna characteristics over a very wide frequency range, and with excellent omnidirectional characteristics. In addition, the interconnection of the first and third conductive layers ensures that the antenna can be made much more compact than previously known antennas, and increases the bandwidth of the antenna. The antenna is further independent of an external ground plane, which makes it very suitable for demanding applications, such as for connection of appliances and devices for the internet of things. Thanks to the broadband/wideband properties, the antenna is furthermore very universally useable, and can be used in most applications and for most countries without any specific customizations.

The second conductive layer, and the possible fourth conductive layer which is electrically connected to the second conductive layer, serves as a ground plane for the antenna. Hereby, the antenna operates without the need for any external ground plane. Furthermore, it means that the antenna works like a mix between a dipole and monopole antenna.

With the new antenna, a surprisingly good mix of overlapping and non-overlapping conductive surfaces has been obtained. It has surprisingly proven to be possible to use partially non-overlapping surfaces to obtain a greatly improved bandwidth, and yet still receive a very high efficiency. If two antenna surfaces on opposite sides are close to each other, there will be a strong coupling between the surfaces through the dielectric substrate. It has previously been considered pointless to make the surface extensions different for these overlapping layers because they couple to each other so that they together form a single pattern from an RF standpoint. The coupling is not complete, but is so great that one could not draw any particular advantage of using both sides of the circuit board. With the new solution, however, the antenna pattern, the first conductive layer, continues down to the bottom of the substrate, to the third conductive layer, thanks to the electrical interconnection of the layers' end edges. The first conductive layer thereby continues under the substrate, though in the opposite direction. Here, too, there is still an inductive and capacitive coupling between the both sides of the substrate through the dielectric substrate, but the difference is fully possible to use in order to extend the antenna's performance, not just for high efficiency over a very wide frequency range but also with well controlled low VSWR and with improved impedance stable properties within the bandwidth. This has also been confirmed experimentally by measurements. Furthermore, the antenna can nevertheless be made small and compact, because it uses the existing antenna space more efficiently. In particular, the inductive and capacitive coupling between the first and third layers is less at lower frequencies, thus providing a larger effective antenna length thanks to the electric interconnection, while the coupling gets bigger at higher frequencies, whereby a shorter effective antenna length is obtained.

The first conductive layer may, according to one embodiment, have a continuously or incrementally increasing width in the direction away from the antenna feed and to the first end edge. Specifically, the first conductive layer may have a continuously increasing width in the direction away from the antenna feed, and preferably an essentially triangular shape.

According to an embodiment, the second conductive layer has a fork-shaped design, with two arms extending along the sides of the first conductive layer, passing the antenna feed, and in the direction of the said end edge. This contributes to a bandwidth increasing capacitance and inductance of the antenna, and also contribute to a better use of the available space and a larger ground plane. Specifically, the two fork arms may, according to one embodiment, have different width and area. At least one, and preferably both, the fork arms is/are preferably wedge-shaped, and has/have a decreasing width in the direction of the end edge of the first conductive layer over at least part of their extension. The asymmetry of the two fork arms provides a decreased inductive coupling between them.

According to an embodiment, the second conductive layer comprises a substantially constant width, ranging from the antenna feed and away from the first conductive layer. This substantially rectangular surface can then be supplemented with additional surface areas, such as the previously-discussed fork arms.

The antenna feed is preferably arranged relatively central on the first surface. Alternatively, however, it is also possible to place the antenna feed in other places, such as offset against one of the long sides of the substrate. In one embodiment, the antenna feed is placed on or in the vicinity of one of the long sides.

The third conductive layer is preferably provided with a different shape/design than the first conductive layer, whereby the third conductive layer only partially overlaps with the first conductive layer. This contributes to bandwidth increasing capacitance and inductance of the antenna and reduces the coupling between the layers. In accordance with one embodiment, the third conductive layer has a fork shape, with arms that extend at the sides in a direction away from the said end edge.

The antenna may also include a fourth conductive layer on the second surface, the extent of which, at least in part, coincides with the second conductive layer of the first surface. This enables a well-functioning ground plane to be formed also on the other side of the substrate. Such double ground planes provide increased stability and better properties at higher frequencies. However, it is also possible to simply have a ground plane on one of the sides. The second and fourth conductive layers are preferably electrically interconnected via a number of interconnection points, and preferably interconnection points distributed over the said second and fourth conductive layers. Alternatively, however, the second and fourth conductive layers be connected only at part of or all of the sides, for example, with a continuous interconnection.

The third and fourth conductive layer are, according to one embodiment, separated from each other by a non-conductive zone. In the case of fork-shaped arms at both the third and fourth conductive layer, the fork ends are the parts that are closest to each other in each layer. The forks pointing to each other provides a controlled capacitive coupling between the layers, and can be controlled by controlling the distance. If more capacitance is wanted, the distance between the forks can be decreased. Also, the width of the forks will affect this coupling, and can be dimensioned based on the context. In this way, a short circuit between the layers can be obtained at high frequencies and no connection at low frequencies.

The fourth conductive layer preferably has a larger area than the third conductive layer.

According to one embodiment, the fourth conductive layer has an area and a geometry which largely coincides with that of the second conductive layer.

The electrical interconnection between the first and third layer is preferably distributed over the length of the end edges. This can be achieved by means of a number of distributed connections, such as through going connections, so called via holes, provided through the substrate. However, it can also be accomplished with one or more continuous length extensions, such as by means of a conductive layer which extends along the border of the substrate, between the end edges of the layers. In this case, the first and third conductive layer may also be arranged as a continuous surface, which is folded over the substrate edge.

The substrate can be dimensioned so that its extent substantially coincide with the antenna. This is an advantage if the antenna is to be manufactured as a stand-alone device. However, it is also possible to arrange the antenna as a part of a larger substrate. Such a larger substrate may also contain additional conductive structure and/or components, such as transmitter(s)/receiver(s) for the antenna, battery, display, signal processing circuitry, processor, etc.

Additional specific features, benefits, and the like of the new antenna are disclosed in the detailed description below.

BRIEF DESCRIPTION OF THE DRAWINGS

The invention will now be described in more detail with reference to exemplary embodiments, and with reference to the attached drawings. The figures of the drawings show:

FIG. 1*a* shows the top side of the circuit board, and FIG. 1*b* shows the bottom side of the circuit board;

DETAILED DESCRIPTION

With reference to FIG. 1, a dielectric substrate 1, such as a printed circuit board ("Printed Circuit Board, PCB), is shown, conductive layers are provided to form an omnidirectional, wideband/broadband antenna in accordance with an embodiment thickness of e.g. a few tenths of a millimeter. The substrate can, advantageously, be rectangular, as shown in the illustrated embodiment. However, the circuit board may also adopt other shapes.

Figure 1A:
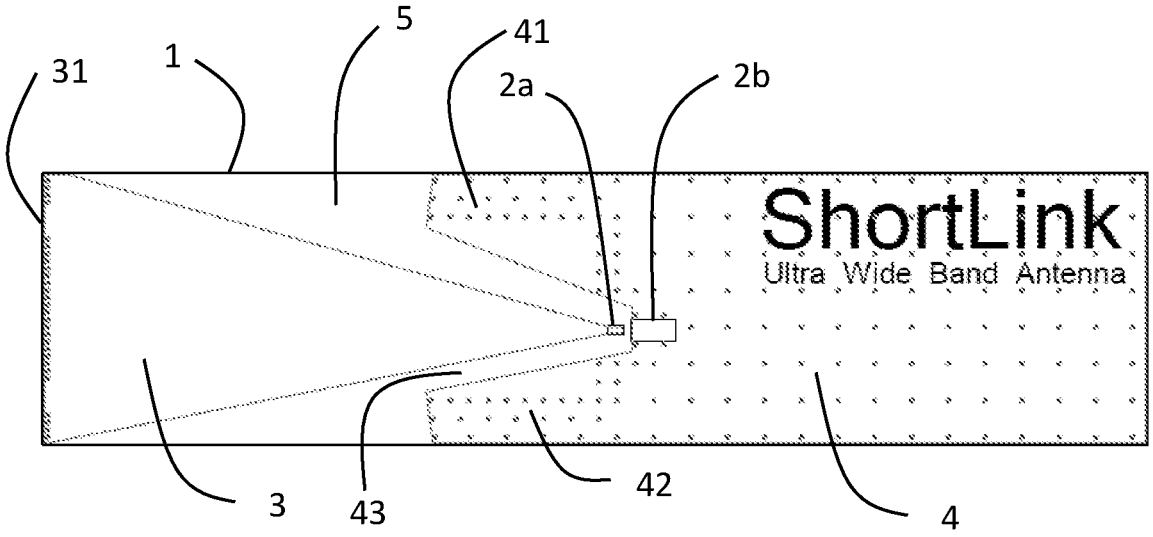
FIGS. 1*a* and 1*b* is a circuit board with an antenna in accordance with an embodiment of the invention, where
Figure 1B:
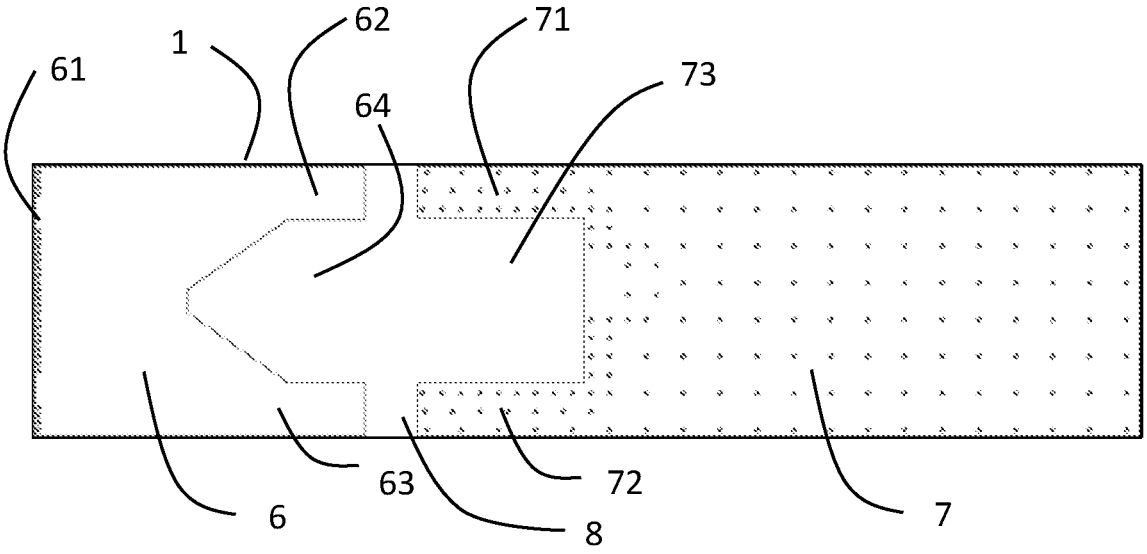

The circuit board includes a first and second surface, which can also be denominated upper side and bottom side. However, it is to be appreciated by the skilled artisan that upper side and bottom side do not necessarily relate to the physical positioning of the sides, but depending on the mounting and application, the upper side may very well be below the bottom side. The first side, the upper side, is shown in FIG. 1*a*, while the other side, the bottom side, is shown in FIG. 1*b*.

The first side is connected to an antenna feed with two conductors, connected to an external transmitter/receiver via e.g. a coax cable or another cable with two conductors. The antenna feed includes a first feed connection 2*a* and a second feed connection 2*b*. The second feed connector is, or acts as, ground.

The antenna feed is preferably arranged relatively centrally on top of the substrate, at a distance, and preferably at about the same distance, from the two long sides and the two short sides. However, it is also possible to provide the antenna feed in a non-centralized position. For example, the antenna feed may be provided displaced towards one of the long sides, or even at one of the long sides.

Further, the first side comprises a first conductive layer 3 which extends from the antenna feed in a first direction and which is electrically connected to the first feed connection 2*a*. The first conductive layer has an increasing width in a direction away from the antenna feed 2*a* and towards a first end edge 31. In the illustrative embodiment, the first conducting layer has a continuously increasing width, and has a triangular shape, with one of the ends connected to the antenna feed 2*a*, and the opposite triangle side forming the end edge 31. The first conductive layer can also be shaped in other ways. For example, the width may instead increase stepwise, and with areas of constant width in between. The increase in width can also be non-linear, so that the area instead, for example, has the shape of a funnel or a horn.

The first side further includes a second conductive layer 4, which essentially extends in a second direction, away from the first conductive layer 3. The second conductive layer 4 is electrically connected to the second feed connection 2*b*, thus forming antenna grounding.

A non-conductive zone 5 is provided between the first conductive layer 3 and the second conductive layer 4, thus forming an electrical separation between the layers.

According to an embodiment, the second conductive layer 4 may have a substantially constant width, extending from the antenna feed and away from the first conductive layer. This area may be substantially rectangular. The width of this area can be substantially the same width as the widest part of the first conductive layer, i.e. in the case of the now showed embodiment, the width of the end edge 31.

The second conducting layer can also have a fork shaped design, with two arms 41 and 42 extending along the sides of the first conductive layer 3, past the antenna feed 2*a*, 2*b* and towards the end edge 31. The two fork arms can have different widths and areas. In the illustrated example, the fork arm 41 has a broader base and a larger area than the fork arm 42. At least one, and preferably both, the fork arms is/are further preferably wedge-shaped, and has/have a decreasing width in the direction towards the end edge of the first conductive layer over at least part of its/their extension. Specifically, the wedge shape may be in the form of a truncated wedge, with a blunt end facing the end edge 31 of the first conductive layer 3. Expressed differently, the second conductive layer comprises a non-conductive indentation 43, into which the first conductive layer extends, and in the bottom of which the antenna feeds 2*a* and 2*b* are located.

The second surface, the bottom side, includes a third conductive layer 6 which extends from a second end edge 61 in the direction towards the antenna feed 2*a*, 2*b*, and with an extension that at least in part coincides with the extension of the first conductive layer 3 on the first surface.

The first end edge 31 at the first conductive layer 3 and the second end edge 61 of the third conductive layer 6 substantially coincide with each other, i.e. are above each other, but on either side of the substrate. Furthermore, the first and third conductive, electrical layers are electrically interconnected with each other at or near said end edges 31, 61. This electrical interconnection can be achieved by means of electrical through connections, called via holes, at or near the end edges, as is shown by means of dots in FIGS. 1*a* and 1*b*. Preferably several such electrical through connections are provided, and distributed along the end edges. The electrical connection can, however, also be accomplished in other ways, such as through a continuous connection that extends along the short edge of the substrate, by means of a number of wires that stretch along the short edge of the substrate, or the like. In addition to this electric interconnection at the edges, the first and the third layers are electrically separated from each other, i.e. there is no additional electrical interconnection between these layers.

By this electric interconnection at the end edges, the third conductive layer forms a fold-over extension of the first conductive layer.

The third conductive layer preferably has a different design and shape than the first conductive layer, whereby the third conductive layer only partially overlaps with the first conductive layer. Hereby, the first and third conductive layers both have surface areas that overlap, i.e. are above each other, and surface areas that do not coincide. Preferably, both the first and third conductive layer comprise surface areas which do not coincide with corresponding surface areas in the other layer.

In the illustrated embodiment, the third conductive layer has a fork shape, with fork arms 62, 63 extending along the sides in a direction away from the end edge 61. These fork arms preferably extend along the long sides of the substrate, and outside the tip of the triangularly shaped first conductive layer, in the direction towards the antenna feed 2*a*, 2*b*.

In the illustrated embodiment the third conductive layer initially, seen from the end edge 61, has a rectangular form, followed by the fork arms. The fork arms are preferably shaped with a first section, seen from the rectangular area, with a gradually decreasing width, and thereafter an end section with essentially uniform width. Differently expressed, the third conductive layer comprises a non-conductive indentation 64, wherein the indentation is relatively centrally arranged, and facing the antenna feed 2*a*, 2*b*.

The length of the third conductive layer is preferably shorter than the length of the first conductive layer.

The second surface may also comprise a fourth conductive layer 7. This layer is preferably electrically interconnected with the second conductive layer 4 at the first surface. The fourth conductive layer 7 and the second conductive layer 4 are preferably interconnected by numerous electrical through connections/via holes, as illustrated by means of dots in the figures, and which are distributed over the entire surfaces of the second and fourth conductive layers.

The fourth conductive layer preferably has an extension which at least in part coincides with that of the second conductive layer at the first surface. In the illustrated embodiment, the fourth conductive layer has an area and geometry which largely coincides with that of the second conductive layer. Similar to the second conductive layer, the fourth conductive layer 7 may advantageously comprise a larger, rectangular portion, as well as fork arms 71, 72, which extend towards the third conductive layer. Hereby, also the fourth conductive layer preferably forms a non-conductive indentation 73 facing the third conductive layer. Unlike the second conductive layer 4, which has a wedge-shaped indentation in the illustrated embodiment, the fourth conductive layer 7 preferably has a substantially rectangular indentation, i.e. with fork arms that have the same or substantially the same width throughout their extensions.

The third conductive layer 6 and the fourth conductive layer 7 are preferentially separated from each other by a non-conductive zone 8.

The fourth conductive layer 7 preferably has a larger area than the third conductive layer 6.

The antenna can be scaled in dependence of which frequency ranges it is to be optimized for. With a scale factor X, which may for example be 1, the antenna can advantageously have the following dimensions:

The total length can be in the range of 10×-20×cm, and preferably 12×-18×cm, and most preferably 13×-17× cm, such as 15×cm.

The total width can be in the range of 2×-7×cm, and preferably 3×-6×cm, and most preferably 3×-5×cm, such as 3.8×cm.

The length of the first conductive layer can be in the range of 5×-10×cm, and preferably 6×-9×cm, and most preferably 7×-8×cm, such as 7.8×cm.

The length of the second conductive layer can be in the range of 7×-15×cm, and preferably 8×-12×cm, and most preferably 9×-11×cm, such as 10.2×cm.

The length of the third conductive layer can be in the range of 2×-6×cm, and preferably 3×-5×cm, and most preferably 4×-5×cm, such as 4.3×cm.

The length of the fourth conductive layer can be in the range of 7×-15×cm, and preferably 8×-12×cm, and most preferably 9×-11×cm, such as 9.7×cm.

The antenna according to the above discussed embodiment has been tested experimentally. In these measurements it has been demonstrated that the antenna has very good performance over a very wide frequency range.

Figure 2A:
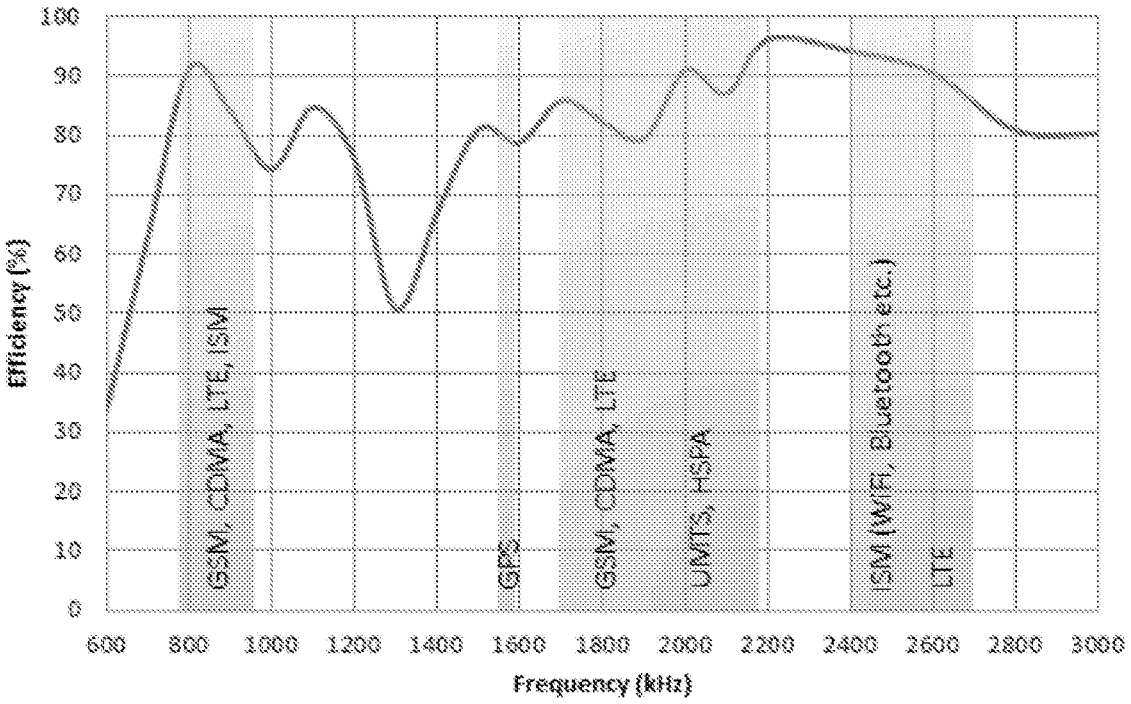
FIG. 2*a-d* are diagrams showing different antenna parameters measured with the antenna in accordance with FIG. 1.

In FIG. 2*a* the measured efficiency (%) for different frequencies are shown. In general, an efficiency of at least 30% is considered good, and over 70-80% as extremely good. It can be seen that the new antenna has extremely high efficiency over a wide frequency range, and especially for the frequencies used for GSM, CDMA, LTE, ISM, GPS, UMTS, HSPA, WiFi, Bluetooth, etc., which are marked as grey in the diagram.

Figure 2B:
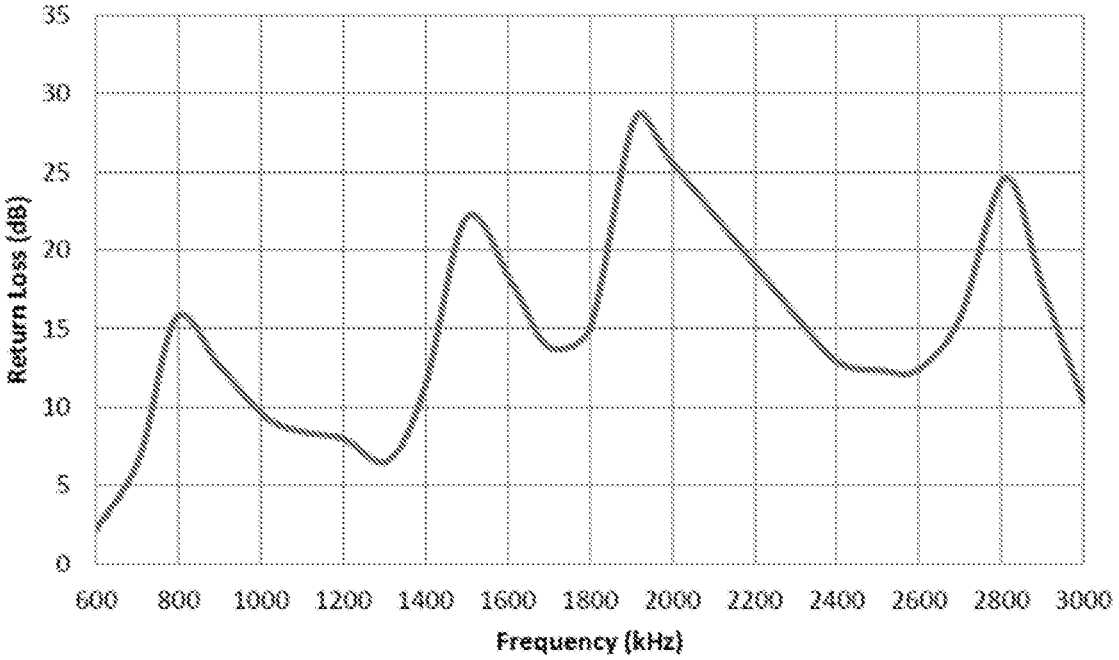
Figure 2C:
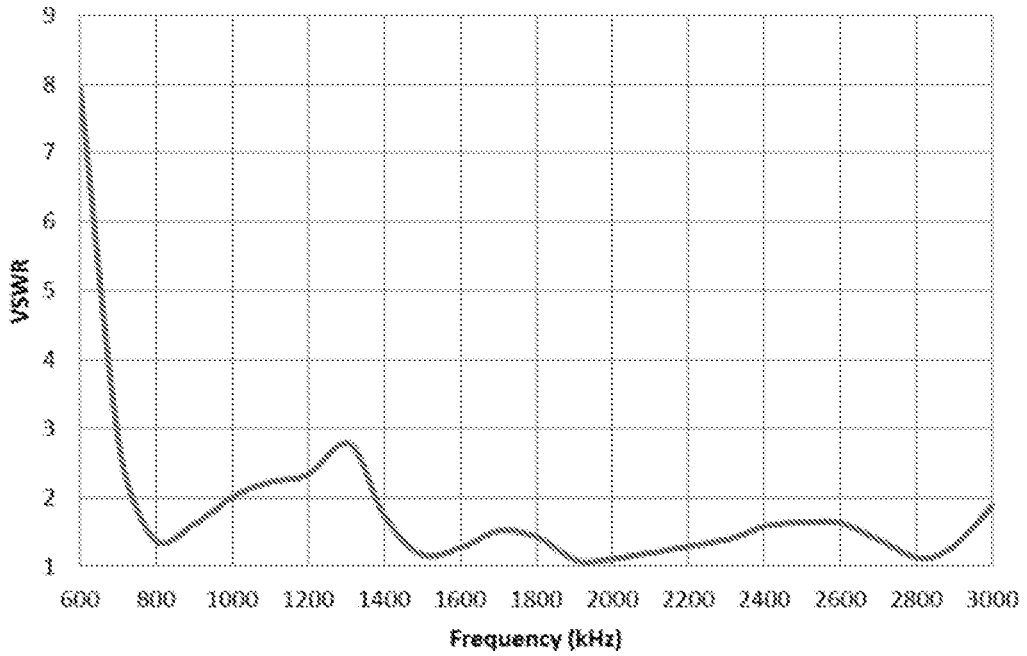

FIG. 2*b* shows the measured return loss in dB for different frequencies. Here, too, it turns out that the measured antenna has very satisfactory performance over the whole measured frequency range.

FIG. 2 *c* shows the measured VSWR (Voltage Standing Wave Ratio) at different frequencies. Generally speaking, VSWR values at 1-3 are fully acceptable, and it was found that the measured antenna has sufficiently low VSWR values over the entire frequency range measured.

Figure 2D:
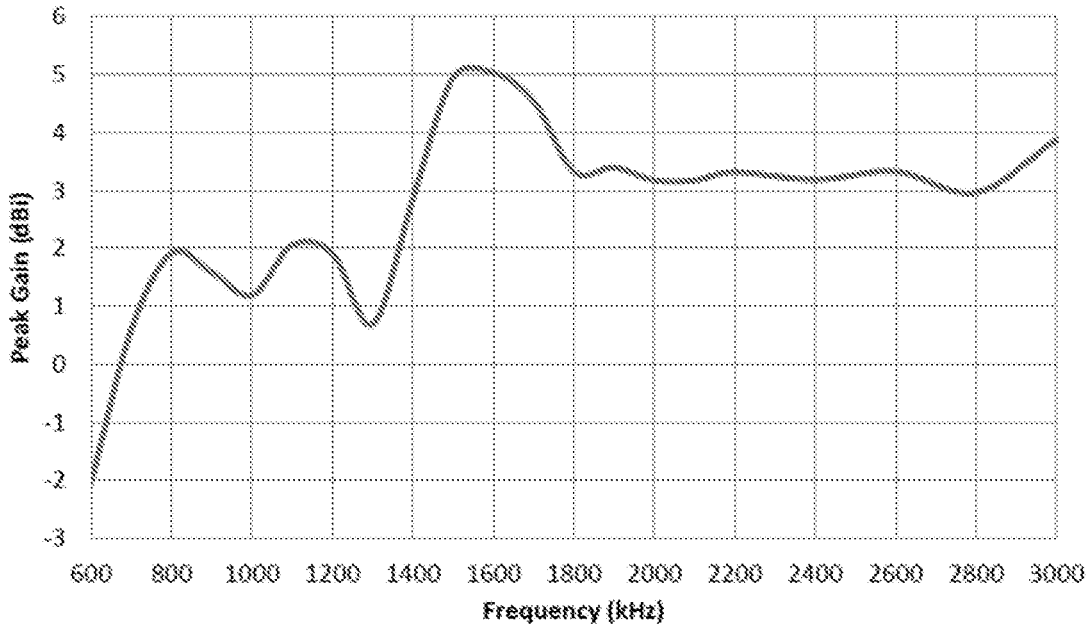

FIG. 2*d* shows the measured Peak Gain (dB) over different frequencies. Peak Gain is a measure of the directivity of the antenna, and for an omnidirectional antenna, it is generally preferred to have relatively low Peak Gain values. It was found that the measured antenna has relatively low values for Peak Gain at all frequencies, and in particular at all frequency ranges that are of interest with respect to available telecommunication standards.

Figure 3A:
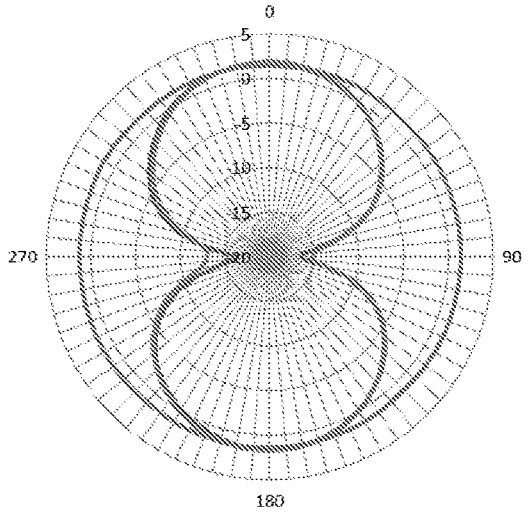
FIG. 3*a-h* are radiation patterns at different frequencies measured with the antenna in accordance with FIG. 1.
Figure 3B:
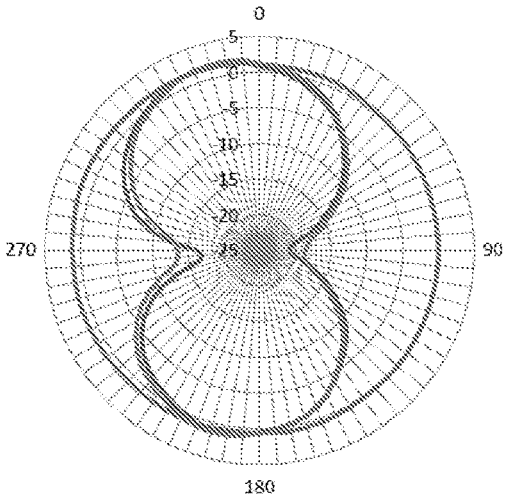
Figure 3C:
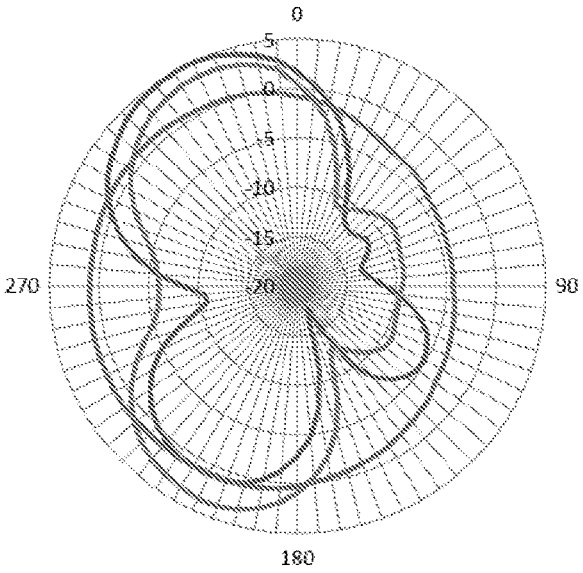
Figure 3D:
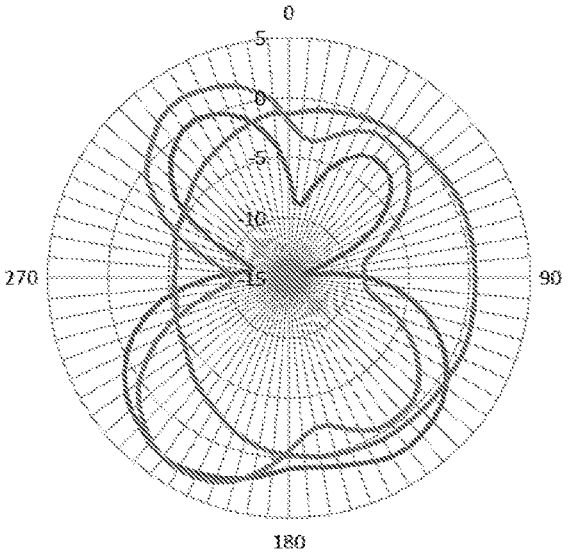
Figure 3E:
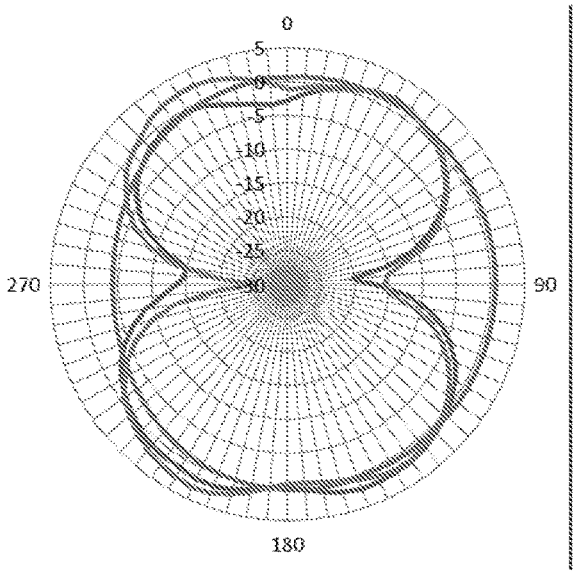
Figure 3F:
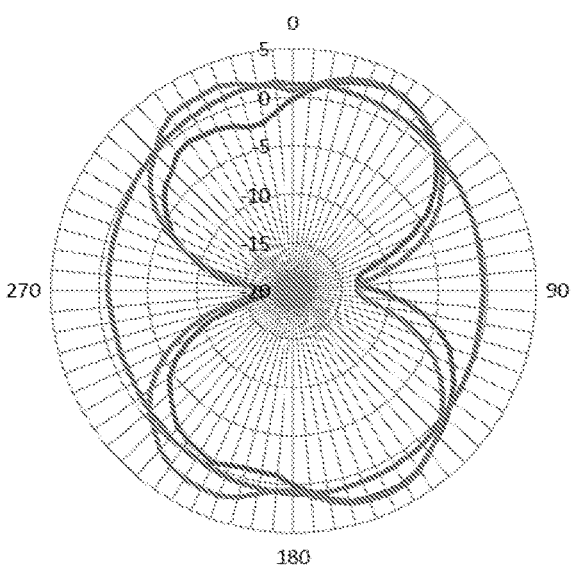
Figure 3G:
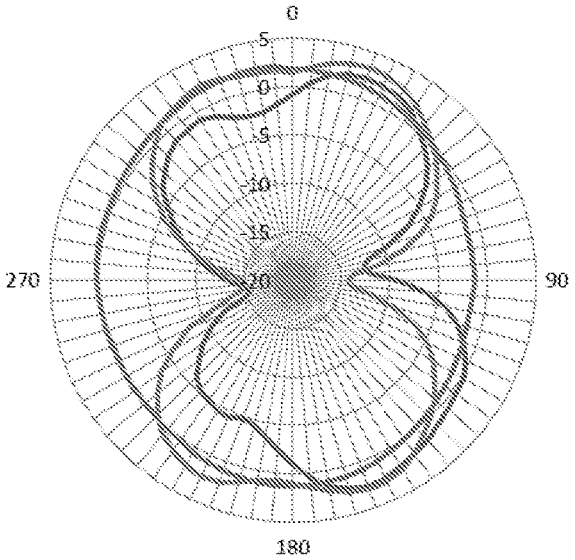
Figure 3H:
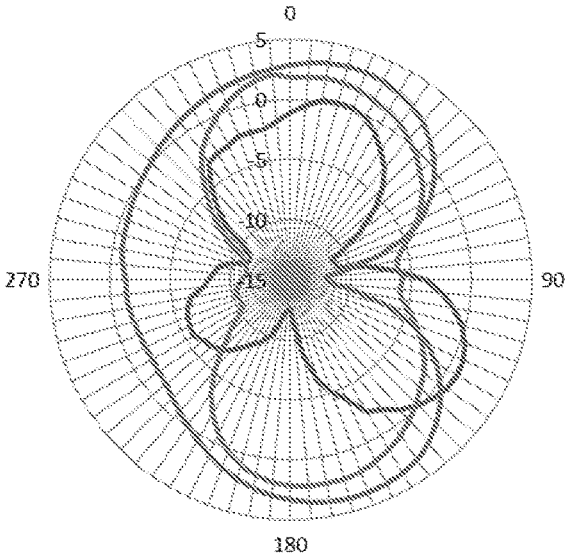

FIGS. 3*a-h* show radiation patterns for various frequencies in dBi, and in X (landscape), Y (portrait) and Z (page position). More specifically, the following is shown: FIG. 3*a* shows the radiation pattern for 800 MHz; FIG. 3*b* shows the radiation pattern for 1200 MHz; FIG. 3*c* shows the radiation pattern for 1500 MHz; FIG. 3*d* shows the radiation pattern for 1900 MHz; FIG. 3*e* shows the radiation pattern for 2100 MHz; FIG. 3*f* shows the radiation pattern for 2400 MHz; FIG. 3*g* shows the radiation pattern for 2600 MHz; and FIG. 3*h* shows the radiation pattern for 3000 MHz.

All radiation patterns clearly show that satisfactory omnidirectional radiation is achieved at all the measured frequencies.

The invention has now been described by use of exemplary embodiments. It should, however, be appreciated by the skilled reader that many alternatives and modifications of these embodiments are possible. For example, the geometries of the different conductive layers may be varied in different ways, as is also discussed above. Moreover, it suffices for many applications with a ground plane arranged only at one of the sides/surfaces, instead of using dual ground planes, as in the above discussed embodiment. In multilayer substrates, more than two ground planes may also be used. In the above discussed embodiment the substrate is further dimensioned so that the substrate's extension substantially coincides with the extension of the antenna. This is an advantage if the antenna is to be manufactured as a stand-alone device. However, it is also possible to arrange the antenna as part of a larger substrate. Such a larger substrate may then also contain additional conductive/wire structure and/or components, such as a transmitter/receiver for the antenna, a battery, a display, signal processing circuits, a processor, etc. These and other related alternatives of the invention shall be regarded as falling within the scope of protection defined in the appended claims.

The invention claimed is:

1. A wideband/broadband antenna comprising:

a dielectric substrate with a first and second surface, wherein the first surface comprises:

an antenna feed with two conductors, comprising a first feed connection and a second feed connection, wherein the second feed connection is or acts as the ground;

a first conductive layer which extends from the antenna feed in a first direction and which is electrically connected to the first feed connection, wherein the first conductive layer extends in a direction away from the antenna feed, and to a first end edge;

a second conductive layer that primarily extends in a second direction, away from the first conductive layer, and which is electrically connected to the second feed connection; and a non-conductive zone separating the first and second conductive layers; and wherein the second surface comprises:

a third conductive layer which extends from a second end edge in the direction towards the antenna feed, the extent of which at least in part coincides with that of the first conductive layer at the first surface, the first end edge of the first conductive layer and the second end edge of the third conductive layer coinciding, and wherein the first and third conductive layers are electrically connected with each other at or near said end edges, and wherein the first and third conductive layers, apart from said electrical interconnection at the edges, are electrically separated from each other;

wherein the second conductive layer has a fork-shaped configuration, with two fork arms extending along the sides of the first conductive layer, past said antenna feed and in a direction towards the first end edge, and wherein the first conductive layer forms a solid layer having a continuously or incrementally increasing width in a direction away from the antenna feed and towards the first end edge.

2. The antenna of claim 1, wherein the first conductive layer has a continuously increasing width in the direction away from the antenna feed.

3. The antenna of claim 1, wherein the two fork arms differ in width and area.

4. The antenna of claim 1, wherein at least one of the two fork arms are wedge-shaped and has a decreasing width in the direction of the end edge of the first conductive layer over at least part of its extension.

5. The antenna of claim 1, wherein the second conductive layer comprises a surface with a constant width, extending from the antenna feed and away from the first conductive layer.

6. The antenna of claim 1, wherein the antenna feed is arranged relatively centrally on the first surface.

7. The antenna of claim 1, wherein the third conductive layer has a different shape than the first conductive layer, whereby the third conductive layer only partially overlaps with the first conductive layer.

8. The antenna of claim 1, wherein the third conductive layer has fork-shape, with arms extending at the sides in a direction away from the second end edge.

9. The antenna of claim 1, further including a fourth conductive layer on the second surface, the extent of which at least in part coincides with the second conductive layer on the first surface.

10. The antenna of claim 9, wherein the second and fourth conductive layers are electrically connected by a plurality of interconnection points.

11. The antenna of claim 9, wherein the third and fourth conductive layers are separated from each other by a non-conductive zone.

12. The antenna of claim 9, wherein the fourth conductive layer has an area and geometry which largely coincides with that of the second conductive layer.

13. The antenna of claim 1, wherein the electrical interconnection between the first and third conductive layers is distributed over the length of the end edge.

14. The antenna of claim 1, wherein both of the two fork arms are wedge-shaped and have a decreasing width in the direction of the first end edge of the first conductive layer over at least part of its extension.

15. A wideband/broadband antenna comprising:

a dielectric substrate with a first and second surface, wherein the first surface comprises:

an antenna feed with two conductors, comprising a first feed connection and a second feed connection, wherein the second feed connection is or acts as the ground;

a first conductive layer which extends from the antenna feed in a first direction and which is electrically connected to the first feed connection, wherein the first conductive layer extends in a direction away from the antenna feed, and to a first end edge;

a second conductive layer that primarily extends in a second direction, away from the first conductive layer, and which is electrically connected to the second feed connection; and a non-conductive zone separating the first and second conductive layers; and wherein the second surface comprises:

a third conductive layer which extends from a second end edge in the direction towards the antenna feed, the extent of which at least in part coincides with that of the first conductive layer at the first surface, the first end edge of the first conductive layer and the second end edge of the third conductive layer coinciding, and wherein the first and third conductive layers are electrically connected with each other at or near said end edges, and wherein the first and third conductive layers, apart from said electrical interconnection at the edges, are electrically separated from each other;

wherein the second conductive layer has a fork-shaped configuration, with two fork arms extending along the sides of the first conductive layer, past said antenna feed and in a direction towards the first end edge, wherein the first conductive layer forms a solid layer having a continuously or incrementally increasing width in a direction away from the antenna feed and towards the first end edge, and wherein the first conductive layer has a triangular shape.

16. The antenna of claim 9, wherein the second and fourth conductive layers are electrically connected by a plurality of interconnection points distributed over said second and fourth conductive layers.

17. A wideband/broadband antenna comprising:

a dielectric substrate with a first and second surface, wherein the first surface comprises:

an antenna feed with two conductors, comprising a first feed connection and a second feed connection, wherein the second feed connection is or acts as the ground;

a first conductive layer which extends from the antenna feed in a first direction and which is electrically connected to the first feed connection, wherein the first conductive layer extends in a direction away from the antenna feed, and to a first end edge;

a second conductive layer that primarily extends in a second direction, away from the first conductive layer, and which is electrically connected to the second feed connection; and a non-conductive zone separating the first and second conductive layers;

and wherein the second surface comprises:

a third conductive layer which extends from a second end edge in the direction towards the antenna feed, the extent of which at least in part coincides with that of the first conductive layer at the first surface, the first end edge of the first conductive layer and the second end edge of the third conductive layer coinciding, and wherein the first and third conductive layers are electrically connected with each other at or near said end edges, and wherein the first and third conductive layers, apart from said electrical interconnection at the edges, are electrically separated from each other; and a fourth conductive layer on the second surface, the extent of which at least in part coincides with the second conductive layer on the first surface, wherein the fourth conductive layer has an area and geometry which largely coincides with that of the second conductive layer.

18. The antenna of claim 1, wherein the electrical connection between the first and third conductive layers at or near the end edges is distributed along the end edges.

19. The antenna of claim 1, wherein the first end edge of the first conductive layer and the second end edge of the third conductive layer wholly coincide.

* * * * *